United States Patent [19]

Riha

[11] Patent Number: 4,494,926

[45] Date of Patent: Jan. 22, 1985

[54] WICK HOLDER FOR A LIQUID-FUEL LAMP

[76] Inventor: Hans J. Riha, Biscayne, Port Marnock, Dublin, Eire., Ireland

[21] Appl. No.: 522,052

[22] Filed: Aug. 10, 1983

[30] Foreign Application Priority Data

May 5, 1983 [GB] United Kingdom ..... 8312334

[51] Int. Cl.[3] ..... F23D 3/13

[52] U.S. Cl. ..... 431/321; 431/324

[58] Field of Search ..... 431/320, 321, 322, 324, 431/298

[56] References Cited

U.S. PATENT DOCUMENTS 194,860 9/1877 Chinnock ..... 431/321

664,167 12/1900 Moegling ..... 431/320

*Primary Examiner*—Carroll B. Dority, Jr.

*Attorney, Agent, or Firm*—Bell, Seltzer, Park & Gibson

[57] ABSTRACT

A wick holder for a liquid-fuel burning lamp comprises a support (3) in the form of a circular button-like metal pressing formed to be a press-fit in the neck (2) of a fuel containing receptacle (1). Support (3) comprises a central portion with an apertured central portion (4) the contour of which is constituted by inwardly projecting fingers (5) and is pressed out to form a projection (10) from the remainder of the support (3). A wick tube (6) which may be either plane or beaded is pressed through the aperture (4) to engage the fingers (5) so that the fingers elastically grip the tube (6) in a desired axial position and a wick (8) extends through the tube (6) into the fuel within container (1).

6 Claims, 3 Drawing Figures

WICK HOLDER FOR A LIQUID-FUEL LAMP

The subject of this invention is a wick holder for a liquid-fuel burning lamp.

It is becoming the practice in situations where candles would normally be used for decorative, ceremonial or ritual purposes to use oil burning lamps, the lamps using as fuel an oil which is usually of a type which is odour free or perfumed.

A difficulty often associated with the use of candles particularly in ecclesiastical buildings such as churches is keeping the candles alight since a candle placed near a door which is frequently being opened is liable to be either blown out or to turn much faster and flicker and emit smoke. This difficulty is also found in oil lamps constructed to simulate candles and it is an object of the present invention to provide a wick holder for a oil lamp which avoids this difficulty. It is also a further object of the present invention to provide a wick holder which when used in conjunction with an oil lamp causes the flame to be extinguished if the lamp should be overturned.

A wick holder according to the invention comprises a wick support in the form of a circular button-like metal pressing formed to be a press fit in the neck of an oil-containing receptacle, the centre of the pressing being formed with an aperture presenting radially inwardly projecting fingers and a wick tube of heat-resisting material forced partly through the aperture so that the fingers flex as the tube is pushed through and by their own elasticity grip the tube frictionally and hold it in a desired axial position in the wick support.

The wick tube may be formed at one end with a solid annular bead surrounding the tube, the bead being either of the same material as the tube or of another heat-resisting material.

The invention also includes an oil lamp comprising an oil reservoir formed with a neck and a wick holder as described fitted into the neck.

The wick support may be dished to present a peripheral substantially cylindrical flange dimensioned to be a press fit into the neck of a liquid fuel receptacle with which the wick holder is to be used and the bottom of the dish may be pressed outwards to form a projection coaxial with the flange and having the shape of an inverted cup the bottom of which is formed with the aperture for the wick tube. The projection may be slightly coned so that a cover may be frictionally engaged with the projection to enclose the wick.

Figure 1:
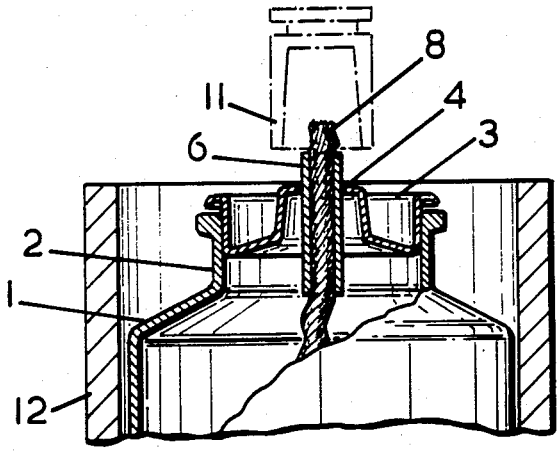
Figure 2:
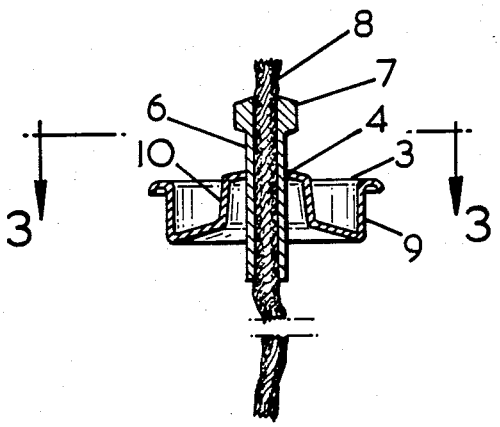
Figure 3:
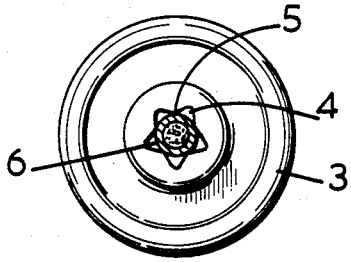

A practical embodiment of the invention is illustrated in the accompanying drawings in which FIG. 1 illustrates the upper end of a fuel receptacle with a wick holder incorporating a plain wick tube in position on it, the assembly being shown in part section, FIG. 2 illustrates in section a wick holder fitted with a wick tube incorporating an annular bead surrounding the upper end of the tube and FIG. 3 is a section through the line 3—3 in FIG. 2. FIG. 3 also represents a section of the wick holder of FIG. 1 through an identical position.

In the drawings 1 denotes a receptacle for liquid fuel (usually a high flash point oil) formed with a neck 2, 3 denotes a button-shaped wick support pressed into the neck 2, the wick support 3 being formed with a central aperture 4 the contour of which is constituted by inwardly projecting fingers 5 so that the general appearance of the aperture is that of a star. The wick tube 6 is illustrated in FIG. 1 as a plain tube projecting through the aperture 4, the tube having been pressed through the aperture so that the fingers 5 bend flexibly with the points engaging the tube and hold the tube firmly in place and the wick tube of the construction of FIG. 2 is formed with a surrounding bead 7. 8 denotes a wick inserted through the wick tube, the wick being long enough to reach fuel in the container 1. The wick support 3 is dished so that it presents a peripheral substantially cylindrical flange 9 dimensioned to be a press fit in the neck of a liquid fuel receptacle with which the wick holder is to be used and the bottom of the dished portion of the wick support is pressed out to form a projection 10 like an inverted cup the sides of which are slightly coned so that a cover for the wick shown at 11 in phantom may be pressed on to and grip the projection. 12 denotes a casing which may be of translucent material arranged to contain the fuel receptacle 1 and simulate a candle.

In practice and referring first to the construction of FIG. 1, this is the construction to be used where there is most danger that the lamp may be knocked over, for example on a restaurant table. In this construction first of all the length of the flame is adjusted by adjusting the amount by which the wick 8 projects from the wick tube 6. Normally the spaces between the fingers 5 allow of the entry of air to the fuel receptacle 1 to replace oil burned while the lamp is lit. If the lamp is knocked over the fuel within the receptacle in surging causes a blast of the air within the receptacle above the fuel to be ejected suddenly through the gaps between the fingers 5 and this blast of air has been found to be sufficient to extinguish the flame burning on the wick. In the construction of FIG. 2 the annular bead 7 becomes hot while the lamp is burning and it has been found that the pre-heating effect of this on the fuel rising in the wick by capillary attraction causes the flame to tend to be hotter and to resist better draughts of air which otherwise would blow the flame out. This construction also shows the attributes of selfextinguishment if the lamp is knocked over although if the lamp is to be used in a situation where the lamp is likely to be knocked over it is desirable that the gaps between the fingers 5 should extend radially outwards a distance greater than the radius of the bead 7 to ensure that the blast of air from the receptacle can pass on across the bead 7 and not be deflected thereby clear of the flame.

What is claimed is:

1. A wick holder for a liquid-fuel burning lamp comprises a wick support in the form of a button-like metal pressing formed to be a press-fit in the neck of a liquid-fuel containing lamp, the centre of the pressing being formed with an aperture presenting radially inwardly projecting fingers, and a wick tube of heat resisting material forced partly through the aperture so that the fingers flex as the tube is pushed through and by their own elasticity grip the tube frictionally and hold it in a desired axial position in the wick support, the fingers being spaced apart around the aperture to permit air flow therethrough when the tube is gripped by the fingers.

2. A wick holder as claimed in claim 1 wherein the the pressing includes an annular trough.

3. A wick holder as claimed in claim 2 wherein the annular trough includes an annular wall of circular cross-section and adapted to be frictionally engaged by a cover.

4. A wick holder as claimed in claim 3 wherein the wall is conical.

5. A wick holder as claimed in claim 1 wherein the wick tube is provided at one end with a solid annular bead.

6. A wick holder as claimed in claim 5 wherein said bead is made of a heat resisting material being a different material from that of the said tube.

* * * * *